United States Patent [19]

Herstein et al.

[11] Patent Number: 4,458,222

[45] Date of Patent: Jul. 3, 1984

[54] WAVEGUIDE TO MICROSTRIP COUPLER WHEREIN MICROSTRIP CARRIES D.C. BIASED COMPONENT

[75] Inventors: Dov Herstein, Princeton; Leonard S. Rosenheck, Morris Plains, both of N.J.

[73] Assignee: Microwave Semiconductor Corporation, Somerset, N.J.

[21] Appl. No.: 261,145

[22] Filed: May 6, 1981

[51] Int. Cl.[3] ..... H01P 5/107

[52] U.S. Cl. ..... 333/26; 333/35; 333/247

[58] Field of Search ..... 333/21 R, 26, 33–35, 333/247

[56] References Cited

U.S. PATENT DOCUMENTS

| | | | |
|---|---|---|---|
| 3,737,812 | 6/1973 | Gaudio et al. | 333/21 R X |
| 3,878,486 | 4/1975 | Dean | 333/21 R X |
| 3,969,691 | 7/1976 | Saul | 333/21 R |

OTHER PUBLICATIONS

"Millimeter-Wave IC Components Using Fine Grained Alumina Substrate", by H. Yatsuka et al., published 1980, IEEE-MTT-S, International Microwave Symposium Digest, pp. 276–278.

"A K-Band 1 Watt GaAs FET Amplifier", by Sane et al., published 1980, IEEE MTT-S, International Microwave Symposium Digest, pp. 180–182.

"20 GHz Band GaAs FET-Waveguide-Type Amplifier", by Hideki Tohyama, published 1977, IEEE MTT-S, International Microwave Symposium Digest, Jun. 21–23, 1977.

*Primary Examiner*—Paul L. Gensler

*Attorney, Agent, or Firm*—Karl F. Milde, Jr.; Max Moskowitz

[57] ABSTRACT

An apparatus for coupling a waveguide structure to a printed circuit transmission line connected to a solid state device requiring a DC bias comprising: a hollow waveguide connector; a base mounted onto that connector and supporting the transmission line; a transition element, preferably a coupling ridge, for RF coupling the waveguide connector to the transmission line; a connecting means for feeding the DC bias voltage from an external bias network through the wall of the waveguide connector and the transition element to the transmission line. The connecting means, and the transition element are DC insulated from the other parts of the waveguide connector. The built-in DC bias eliminates the need for biasing networks, RF chokes, filters and DC blocks mounted on the printed circuit.

9 Claims, 4 Drawing Figures

WAVEGUIDE TO MICROSTRIP COUPLER WHEREIN MICROSTRIP CARRIES D.C. BIASED COMPONENT

BACKGROUND OF THE INVENTION

1. Field of the Invention

The invention relates to microwave transmission lines including active electronic components. More specifically, it relates to an apparatus for coupling a waveguide structure to a printed circuit transmission line carrying high frequency electronic components which are supplied by a direct current biasing voltage.

2. Description of the Prior Art

The most common mode of transmission at frequencies of 18 GHz and above is a waveguide system. Waveguide systems often employ active devices wherein the term "active device" herein is understood as an electronic device requiring a direct current bias. Such devices usually are implemented in the form of high frequency electronic devices in solid-state technology. It is, therefore, necessary to provide for transistion stages from a waveguide structure to a printed circuit transmission line, such as a slot line or a microstrip line including shielded microstrip lines with suspended substrates. Solid state devices are mounted onto the same substrate and are electrically connected to the transmission line. In a variety of applications two subsequent transition stages are necessary if the electronic device has to be inserted in between the run of the waveguide system.

Such transition stages for coupling a waveguide structure to a printed circuit transmission line are widely used and well known in the art, as may be seen for example, from an article "Millimeter-Wave IC Components Using Fine Grained Alumina Substrate" by H. Yatsuka et al, published in 1980 IEEE MTT's International Microwave Symposium Digest, pages 276–278. This article describes several passive IC components for use with waveguide systems. Passive components which do not require a direct current bias for operating are to be integrated relatively easily into a waveguide system, as long as there are provided matching networks for balancing impedances.

Active electronic devices, however, normally require direct current (D.C.) biasing voltage. In microwave applications the feeding circuitry of the direct current voltage has to be carefully designed, otherwise undesired interference with the radio frequency (RF) network will occur. Conventionally, for applications of a lower frequency range, a radio frequency choke and a low pass filter are used for connecting a direct current voltage source to an active device. For high frequency applications in the millimeter wave range, according to the different technology, a high impedance line connected to the radio frequency network and a printed circuit low pass filter for the direct current by-pass may be provided.

In addition, for blocking the DC voltage component, either a series cut capacitor, or a coupler is inserted into the path of the useful signal. Such an implementation is described and shown in the article "A K-Band 1 Watt GaAs FET Amplifier" by Sane et al, published in 1980 IEEE, MTT's International Symposium Digest, pages 180–182. It is evident from the description with reference to FIGS. 2 and 3 of this article that feeding of the DC bias voltages has considerable impact on the implementation of such an active device, since adding the DC biasing network and a blocking capacitor to the circuit usuallly causes mismatch problems requiring a complicated microstrip network. This design results in an increase of loss. It may be mentioned that the known apparatus overcomes the coupling problems by utilizing coax connectors. Since a transition to coax lines does not imply an electrically short-circuited contact, DC blocking is achieved without further efforts, but it has to be established with a two-stage transition, that is a first transition from the printed circuit transmission line to a coax line and a second transition from the coax line to the waveguide. Obviously, for transmissions along coax cable the DC blocking problem is of minor importance.

For these reasons, efforts have been made to overcome these restrictions with respect to waveguide systems. One approach is knwon from an article "20 GHz Band GaAs FET-Waveguide-Type Amplifier" by Hideki Tohyama, published in 1977 IEEE MTT's International Microwave Symposium Digest June 21–23, 1977, San Diego, Calif. describing an arrangement wherein the active device is integrated into the waveguide structure. An integration scheme, as shown in FIG. 3 of the last-mentioned article, has the disadvantage that any design is specifically limited to a particular application. The lumped element structure mounted directly into a waveguide therefore, is of limited interest with respect to coupling various and more complex, active devices to a waveguide system, in contrast to printed circuit transmission lines which do not show this drawback. Furthermore, it is assumed that the known structure which is proven at 20 GHz may also have limitations for transmitting signals of high frequencies in terms of smaller gains and less feasibility. Mounting passive and active electronic devices onto a printed circuit transmission line and providing for a low loss transition to the waveguide, therefore, still seems to be the most feasible approach.

SUMMARY OF THE INVENTION

It is, therefore, an object of the present invention to improve the design of the conventional apparatus for coupling a waveguide structure to printed circuit transmission lines carrying active electronic devices.

It is another object of the present invention to improve the mounting of the printed circuit transmission line to the waveguide structure by an enhanced waveguide connector.

Still another object of the present invention is to develop a DC feeding circuitry which overcomes the restriction of the conventional approach with respect to DC coupling and blocking.

These and other objects, features and advantages of the invention which will become apparent from the description that follows are accomplished by providing a waveguide connector having a first end portion adapted to be connected to a waveguide structure and a second end portion connected to the printed circuit transmission line having a cavity corresponding to that of the wave guide. A transition element is mounted on an inner wall of the connector cavity for high frequency coupling to the printed circuit transmission line to the connector. Electrical connecting means feed DC biasing voltage through the connector to the transition element and through the transition element to the printed circuit transmission line. The connecting means and the transition element are insulated from the connector by an electrical insulating material.

An essential aspect of the invention consists in using the transition element for both radio frequency and DC. By electrically insulating the connecting means and the transition element from the waveguide connector, a DC voltage can be supplied directly to the printed circuit transmission line, avoiding the need of capacitors, RF chokes and filters on the microstrip circuit, and avoiding any loss due to a DC block. Moreover, there is no significant reduction of the RF properties of the waveguide to the printed circuit transmission line using a simple dielectric insulator between the transition element and the body of the waveguide connector. Best results are obtained when the waveguide connector has a rectangular cross section, the transition element is a tapered ridge, the dielectric insulator is a thin film and the transmission line is realized as a microstrip line.

BRIEF DESCRIPTION OF THE DRAWINGS

The novel coupler will become more apparent from the following description when taken in conjunction with the accompanying drawing in which.

DESCRIPTION OF THE PREFERRED EMBODIMENTS

Figure 1:
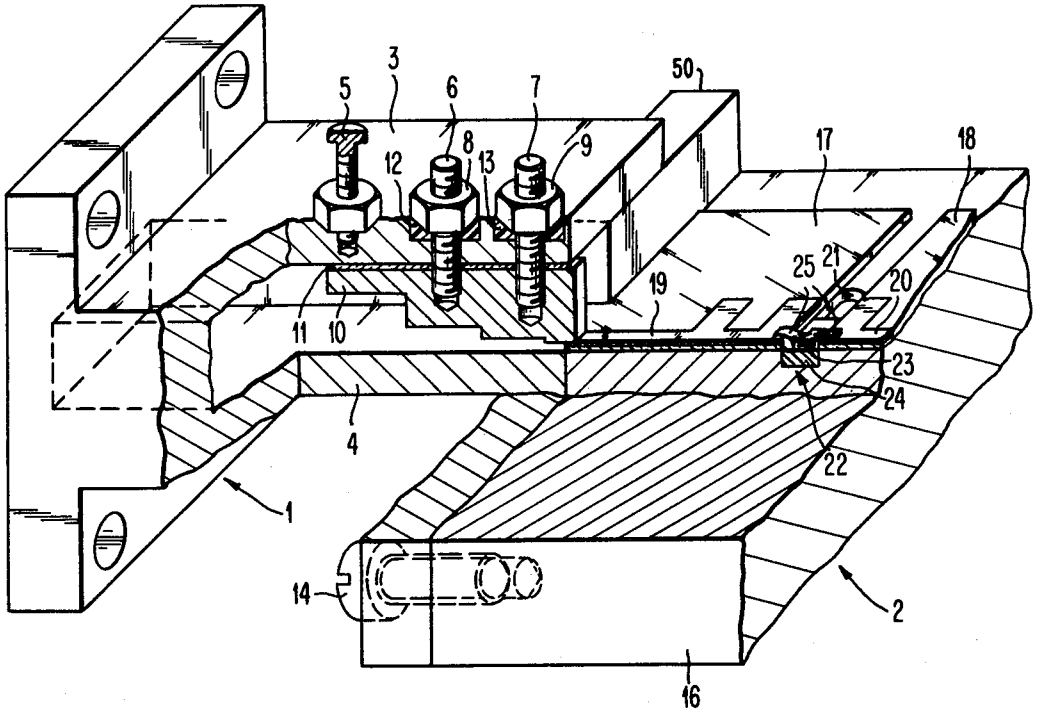
FIG. 1 shows a perspective view, partially cut and broken away, of a coupling apparatus in accordance with the invention.
Figure 2:
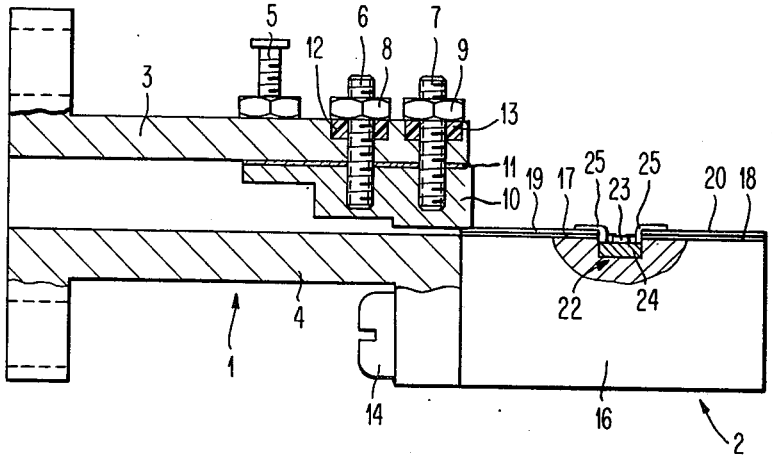
FIG. 2 illustrates a longitudinal cross section view through 2—2 of the apparatus shown in FIG. 1.
Figure 3:
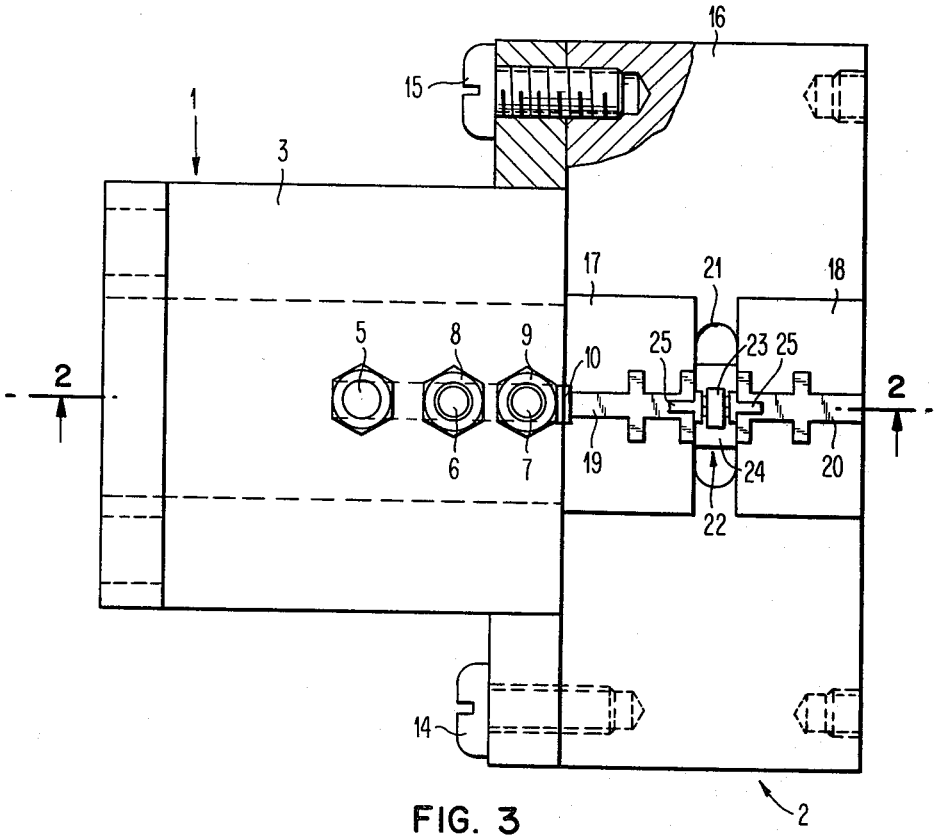
FIG. 3 presents a top view of the apparatus of FIG. 1.

The coupling apparatus of FIGS. 1 through 3 comprises a waveguide connector having preferably a rectangular cross section and including a top part 3, and a bottom part 4. The waveguide connector can be connected to a waveguide structure by means of a flange formed at an end portion thereof.

Top part 3 is provided with a ground terminal screw 5 and a pair of bias-feed screws 6 and 7. These bias screws 6 and 7 can be locked in selected positions by means of arresting nuts 8 and 9. The bias screws 6 and 7 extend through complimentary threaded openings in top part 3 and into the upper portion of an RF quarter-wavelength coupling ridge 10 mounted on the interior upper surface of the top part 3 of the connector. The coupling ridge 10 of narrow generally rectangular and tapered or stepped conducting material, in itself well known, is centered along the longitudinal axis of the connector and extends from the end portion adjacent to the transition line device 2 into the cavity of the connector. However, the screws pass through the top part 3 with clearance and the coupling ridge 10 is separated from the surface by a thin dielectric film 11 providing a DC insulation from the other parts of the connector. Screws 6 and 7 are retained in position by dielectric washers 12 and 13 inserted in recesses of the upper surface of the connector.

Bottom part 4 of each waveguide connector is provided with an inner flange adjacent to the transition line device 2. As is evident from the drawings, the transmission line device 2 is connected to the waveguide connector by screws 14 and 15 mounting a base plate 16 to the inner flange. Spacer 50 is wedged between the bottom part 4 and the top part 3 to provide structural rigidity and support to the waveguide connector.

The base plate, which may be a metallic plate preferably composed of copper or aluminum, supports two quartz substrates 17, 18 on which upper surface microstrip patterns 19, 20 forming a transition line and a matching network are implemented. Typically, such patterns are generated by etching a thin CrAu metallization on the substrate. Microstrip pattern 19 is electrically connected to the ridge 10.

Between the two quartz substrates, the base plate 16 is provided with a center portion, preferably a recess 21, adapted to receive an active electronic device 22. In the present example this device is a field effect transistor (FET) unit including a GaAs FET 23 operating at frequencies above 18 GHz, a base 24 for supporting the GaAs FET and a lead structure for accomplishing the necessary electric connections to the GaAs FET. The base 24 is supported in the recess 21 by the L-shaped flanges 25.

In operation a DC bias voltage from an external bias network (not shown) is supplied to the FET via the bias feed screws, the ridges and microstrip lines. This voltage superimposing the RF voltage within a limited section of the waveguide system does not distort the RF signal and does not cause any additional loss or mismatch.

Figure 4:
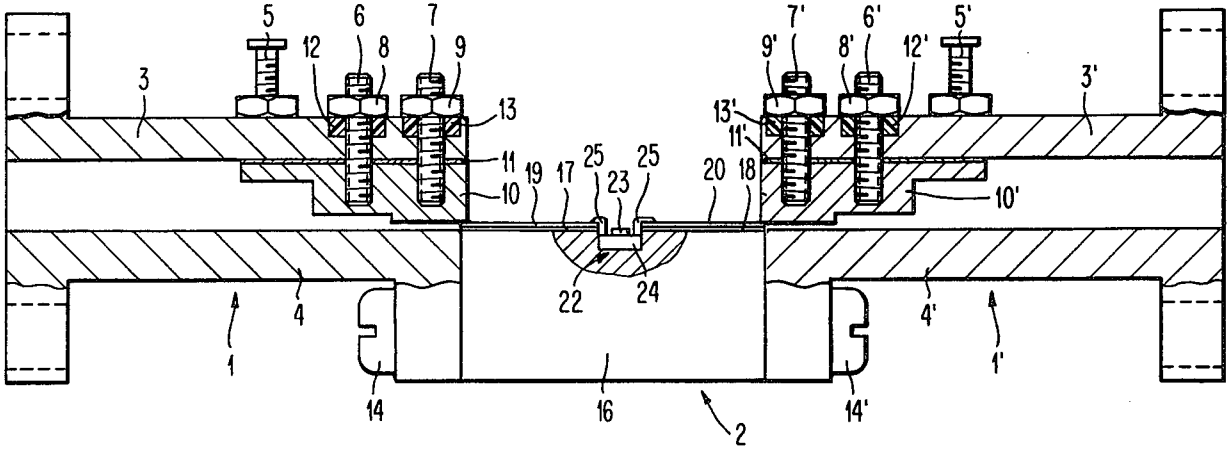
FIG. 4 shows a longitudinal cross-sectional view of another coupling apparatus according to the present invention.

For many applications the electronic device requiring a DC bias should be inserted inbetween the rim of a waveguide system as has been pointed out in the "Background of the Invention". It is within the scope of the present invention that such device mounted onto a printed circuit transmission line can be easily connected to the waveguide system. This structure offers a wide variety of applications in contrast to a system with the device being directly integrated into the waveguide. An implementation of this two-stage transition is shown in FIG. 4. The figure represents a coupler assembly that is distinguished from the coupler shown in the foregoing Figures by having a second waveguide connector connected to the transmission line device 2. The whole assembly is virtually symmetrical with respect to a vertical plane passing through the center of the transition line device. Consequently, all parts shown on the right side of this plane and having a counterpart on the left are denoted by the same reference numbers as their counterparts with an additional prime for distinction.

Various modifications and changes will be readily apparent to those skilled in the art. For instance, the waveguide connector may have a cavity of circular cross section or the printed transmission line may be a slot line. Also the FET may be replaced by any other active solid state device, such as bipolar transistors, Schottky diodes, Impatts or Trappats, requiring a DC bias. Therefore, the foregoing description is a preferred embodiment without restricting the scope of the invention which is limited only by the claims which follow.

What is claimed is:

1. An apparatus for coupling a waveguide to a printed circuit transmission line carrying high frequency electronic components supplied with a direct current biasing voltage requiring electrical insulation from the waveguide structure, said apparatus comprising:

(1) a waveguide connector having a cavity corresponding to said waveguide and having a first end portion adapted to be connected to said waveguide and a second end portion adapted to be connected to said transmission line;

(2) a transition element mounted on an inner surface within the cavity of said connector and extending into said connector for high frequency coupling said printed circuit transmission line thereto, said transition element further extending through said second end portion to reach said transmission line;

(3) electrical connecting means mounted onto and extending into said connector cavity for feeding said direct current biasing voltage through said transition element to said printed circuit transmission line; and (4) direct current insulating means for insulating said electrical connecting means and said transition element from said connector.

2. The apparatus of claim 1, wherein said connector cavity comprises a rectangularly shaped inner cross section.

3. The apparatus of claim 1, wherein said transition element comprises a tapered ridge element.

4. The apparatus of claim 3, wherein said direct current insulating means comprises a dielectric film positioned between said connector and said coupling ridge element.

5. The apparatus of claim 1, wherein said printed circuit transmission line is a microstrip line.

6. The apparatus of claim 5, wherein said microstrip line comprises a matching network pattern.

7. The apparatus of claim 1, wherein said electrical connecting means comprise an electrically conducting element extending into said cavity and being mechanically and electrically connected to said transition element.

8. The apparatus of claim 7, wherein said direct current insulating means comprises a dielectric washer surrounding said conducting element.

9. The apparatus of claim 1, comprising:

(1) a further waveguide connector having a cavity corresponding to said waveguide and having a first end portion adapted to be connected to said further waveguide and a second end portion adapted to be connected to said transmission line;

(2) a base arranged between said waveguide connectors and said printed circuit transmission line mounted onto said base;

(3) a further printed circuit transmission line being mechanically mounted onto said base, said both printed circuit transmission lines being spaced apart from each other by a gap;

(4) a further transition element mounted on an inner surface within the cavity of said further connector and extending into said further connector for high frequency coupling of said further printed circuit transmission line thereto, said further transition element further extending through said second end portion to reach said transmission line;

(5) further electrical connecting means mounted onto and extending into said further connector cavity for feeding said direct current biasing voltage through said further transition element to said further printed circuit transmission line; and (6) further direct current insulating means for insulating said further electrical connecting means and said further transition element from said further connector;

wherein at least one of said high frequency electronic components is mounted onto said base within said gap and is electrically connected to said two printed circuit transmission lines.

* * * * *